US008457509B2

(12) United States Patent
Kitao

(10) Patent No.: US 8,457,509 B2
(45) Date of Patent: Jun. 4, 2013

(54) IMAGE FORMING APPARATUS AND DETECTING METHOD OF PATTERN IMAGE REGARDING IMAGE QUALITY ADJUSTMENT

(75) Inventor: Katsuyuki Kitao, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 185 days.

(21) Appl. No.: 12/852,780

(22) Filed: Aug. 9, 2010

(65) Prior Publication Data

US 2011/0052231 A1 Mar. 3, 2011

(30) Foreign Application Priority Data

Aug. 27, 2009 (JP) ..... 2009-196963

(51) Int. Cl.
*G03G 15/00* (2006.01)

(52) U.S. Cl.
USPC ..... 399/49

(58) Field of Classification Search
USPC ..... 399/49, 261; 250/261
See application file for complete search history.

(56) References Cited

U.S. PATENT DOCUMENTS 5,678,132 A * 10/1997 Shiba et al. ..... 399/59
6,094,557 A * 7/2000 Shinohara ..... 399/302
7,360,886 B2 4/2008 Kitao
7,623,143 B2 11/2009 Kitao
2006/0170754 A1 8/2006 Kitao
2006/0290767 A1* 12/2006 Tezuka et al. ..... 347/115
2007/0053024 A1 3/2007 Kitao
2008/0273903 A1 11/2008 Kitao
2009/0147258 A1 6/2009 Kitao

FOREIGN PATENT DOCUMENTS

JP 2001-324847 11/2001
JP 2003-131443 5/2003
JP 2004-213032 7/2004

* cited by examiner

*Primary Examiner* — Walter L Lindsay, Jr.
*Assistant Examiner* — Frederick Wenderoth
(74) *Attorney, Agent, or Firm* — Oblon, Spivak, McClelland, Maier & Neustadt, L.L.P.

(57) ABSTRACT

An image forming apparatus includes: an obtaining unit that radiates light from a light-emitting unit onto the image carrier and that obtains an output value of a light-receiving unit having received the light reflected from the image carrier; a light amount setting unit that calculates a required light amount value and that sets a light amount adjusting value; a detecting unit that detects a pattern image on the image carrier and by judging whether an output value obtained by radiating light of the light amount adjusting value exceeds a predetermined threshold; and a controller that controls image formation on the image carrier based on a detected result, wherein the detecting unit reduces the threshold when the required light amount value exceeds the limiting value depending on degree of the excess.

20 Claims, 7 Drawing Sheets

IMAGE FORMING APPARATUS AND DETECTING METHOD OF PATTERN IMAGE REGARDING IMAGE QUALITY ADJUSTMENT

CROSS-REFERENCE TO RELATED APPLICATIONS

The present application claims priority to and incorporates by reference the entire contents of Japanese Patent Application No. 2009-196963 filed in Japan on Aug. 27, 2009.

BACKGROUND OF THE INVENTION

1. Field of the Invention

The present invention relates to an image forming apparatus and a detecting method of a pattern image regarding image quality adjustment.

2. Description of the Related Art

Conventional image forming apparatuses form images by forming the images on the image carriers such as transfer belts and transferring the images to recording media such as paper (hereinafter, "paper"). The image forming apparatuses form pattern images for detection on the image carriers, judge output values obtained by reading the pattern images by the sensors using predetermined thresholds to detect the pattern images, and perform image quality adjustment such as concentration adjustment of and positional adjustment of images to be formed on paper based on the detected pattern images.

The sensors used for the image quality adjustment may be subjected to aged deterioration such as contamination due to dust or the like and thus their output values may fluctuate. Therefore, the output of the sensors is previously detected to adjust a light amount while pattern images are read during the image quality adjustment. Moreover, other image forming apparatuses form predetermined reference images on the image carriers and determine thresholds used when pattern images are read, based on the reading result of the reference images (see Japanese Patent Application Laid-open No. 2001-324847, Japanese Patent Application Laid-open No. 2003-131443, and Japanese Patent Application Laid-open No. 2004-213032).

A margin of the light amount adjustment when pattern images are read is limited by specified upper limit of driving current of a light-emitting element or similar limitation. However, the conventional art described above determines thresholds used when pattern images are read without consideration of the limitation of the light amount adjustment, and therefore, is not sufficient to perform pattern detection in response to aged deterioration such as contamination of a sensor.

SUMMARY OF THE INVENTION

It is an object of the present invention to at least partially solve the problems in the conventional technology.

According to the present invention, there is provided an image forming apparatus that forms an image on an image carrier and transfers the image thus formed on paper to be fixed, the image forming apparatus including: an obtaining unit that radiates light from a light-emitting unit onto the image carrier and that obtains an output value of a light-receiving unit having received the light reflected from the image carrier; a light amount setting unit that calculates a required light amount value indicating a light amount required for the light-emitting unit based on the output value and that sets a light amount adjusting value indicating a light amount of the light-emitting unit using a limiting value preset as an upper limit based on the required light amount value thus calculated; a detecting unit that detects a pattern image by forming the pattern image regarding image quality adjustment on the image carrier and by judging whether an output value obtained by radiating light of the light amount adjusting value from the light-emitting unit exceeds a predetermined threshold; and a controller that controls image formation on the image carrier based on a detected result by the detecting unit, wherein the detecting unit reduces the threshold when the required light amount value exceeds the limiting value depending on degree of the excess.

According to another aspect of the present invention, there is provided a detecting method for detecting a pattern image regarding image quality adjustment used in an image forming apparatus that forms an image on an image carrier and transfers the image thus formed on paper to be fixed, the detecting method including: radiating light from a light-emitting unit onto the image carrier and obtaining an output value of a light-receiving unit having received the light reflected from the image carrier; calculating a required light amount value indicating a light amount required for the light-emitting unit based on the output value and setting a light amount adjusting value indicating a light amount of the light-emitting unit using a limiting value preset as an upper limit based on the required light amount value thus calculated; detecting a pattern image regarding image quality adjustment by forming the pattern image on the image carrier and by judging whether an output value obtained by radiating light of the light amount adjusting value from the light-emitting unit exceeds a predetermined threshold; and controlling image formation on the image carrier based on a detected result by the detecting unit, wherein the threshold is reduced at the detecting when the required light amount value exceeds the limiting value depending on degree of the excess.

According to still another aspect of the present invention, there is provided an image forming apparatus that forms an image on an image carrier and transfers the image thus formed on paper to be fixed, the image forming apparatus including: means for obtaining an output value of a light-receiving unit that radiates light from a light-emitting unit onto the image carrier and that obtains the output value of a light-receiving unit having received the light reflected from the image carrier; means for setting a light amount adjusting value that calculates a required light amount value indicating a light amount required for the light-emitting unit based on the output value and that sets a light amount adjusting value indicating a light amount of the light-emitting unit using a limiting value preset as an upper limit based on the required light amount value thus calculated; means for detecting a pattern image by forming the pattern image regarding image quality adjustment on the image carrier and by judging whether an output value obtained by radiating light of the light amount adjusting value from the light-emitting unit exceeds a predetermined threshold; and means for controlling image formation on the image carrier based on a detected result by the means for detecting, wherein the means for detecting reduces the threshold when the required light amount value exceeds the limiting value depending on degree of the excess.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
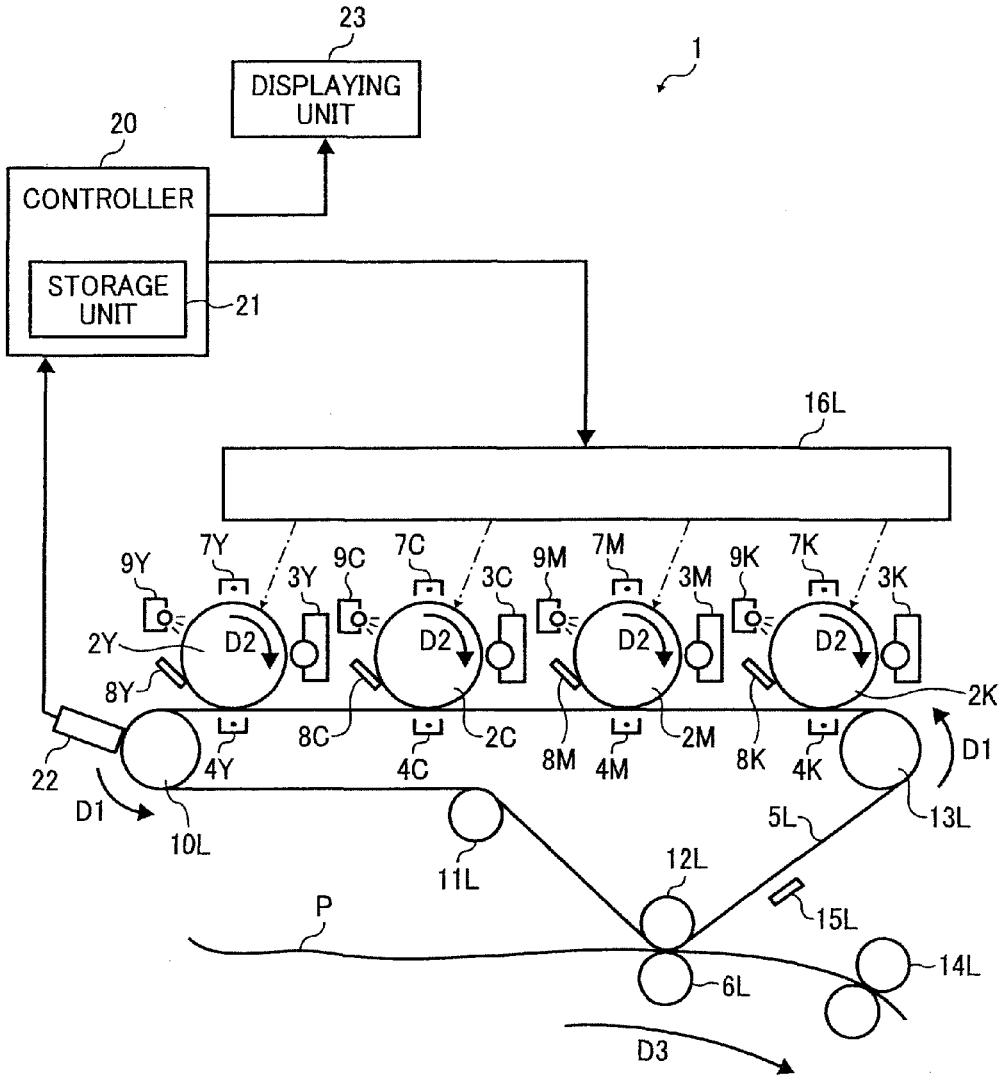
FIG. 1 is a schematic diagram of a structure of a color image forming apparatus according to an embodiment of the present invention.

Exemplary embodiments of an image forming apparatus and a detecting method of a pattern according to the present invention are described below in great detail with reference to the accompanying drawings. FIG. 1 is a schematic diagram of a structure of a color image forming apparatus 1 according to an embodiment of the present invention.

As illustrated in FIG. 1, the color image forming apparatus 1 is of a tandem type utilizing electrophotography and employs an indirect transfer system. In the outline of the indirect transfer system, toner images are formed by developing electrostatic latent images on four cylindrical-shaped photosensitive drums 2Y (yellow), 2C (cyan), 2M (magenta), and 2K (black) that serve as image carriers using developing units 3Y, 3C, 3M, and 3K. The formed toner images are transferred onto an intermediate transfer belt 5L that serves as a transfer medium using primary transfer devices 4Y, 4C, 4M, and 4K subsequently. The image on the intermediate transfer belt 5L is transferred on paper P as a transfer body at a time using a secondary transfer device 6L.

The intermediate transfer belt 5L is an endless belt, is stretched by a plurality of rollers 10L to 13L, and is driven in a rotation direction (sub-scanning direction) D1 at a certain speed by a motor (not illustrated) connected to a shaft of any of the rollers 10L to 13L. An intermediate transfer unit includes the intermediate transfer belt 5L and driving units (such as the motor and the rollers 10L to 13L) for the intermediate transfer belt 5L. The four photosensitive drums 2K, 2M, 2C, and 2Y for black, magenta, cyan, and yellow are arranged in parallel along the rotation direction D1 of the intermediate transfer belt 5L at the upper side of such an intermediate transfer belt 5L. An optical sensor 22 for detecting the toner images formed on the intermediate transfer belt 5L is arranged downstream side of the photosensitive drum 2Y in the rotation direction D1.

Arranged around the photosensitive drums 2K, 2M, 2C, and 2Y, respectively are chargers 7K, 7M, 7C, and 7Y, the developing units 3K, 3M, 3C, and 3Y, the primary transfer devices 4K, 4M, 4C, and 4Y, cleaning devices 8K, 8M, 8C, and 8Y including blades, brushes, or the like, and neutralizing units 9K, 9M, 9C, and 9Y.

The primary transfer devices 4K, 4M, 4C, and 4Y are arranged to face the photosensitive drums 2K, 2M, 2C, and 2Y with the intermediate transfer belt 5L interposed therebetween. In other words, the intermediate transfer belt 5L rotates in a state of being interposed between the primary transfer devices 4K, 4M, 4C, and 4Y and the photosensitive drums 2K, 2M, 2C, and 2Y.

The photosensitive drums 2K, 2M, 2C, and 2Y are driven to be rotated in a rotation direction D2, and during the rotation, the surfaces of the photosensitive drums 2K, 2M, 2C, and 2Y are charged to a predetermined polarity by the chargers 7K, 7M, 7C, and 7Y. The charged surfaces of the photosensitive drums 2K, 2M, 2C, and 2Y are irradiated with laser light output from an optical beam scanner 16L that serves as an optical writing unit using laser diodes (LD), light emitting diodes (LED), electroluminescence (EL), or the like depending on image data, and thus electrostatic latent images are formed on the photosensitive drums 2K, 2M, 2C, and 2Y. Image data radiated as the laser light is data input to the optical beam scanner 16L under the control of a controller 20 and is subjected to a predetermined image process by the controller 20, a digital signal processor (DSP) for image processing (not illustrated), or the like. Each of the electrostatic latent images formed in such a manner is developed to become a toner image in each color by the developing units 3K, 3M, 3C, and 3Y to be visualized.

The toner images thus developed in black, magenta, cyan, and yellow on the photosensitive drums 2K, 2M, 2C, and 2Y are transferred on the surface of the intermediate transfer belt 5L subsequently to be overlapped by the action of the primary transfer devices 4K, 4M, 4C, and 4Y, and thus a combined color image in full color is formed.

The toner images remaining on the photosensitive drums 2K, 2M, 2C, and 2Y are cleaned by the cleaning devices 8K, 8M, 8C, and 8Y, and then the photosensitive drums 2K, 2M, 2C, and 2Y are neutralized by the neutralizing units 9K, 9M, 9C, and 9Y.

The secondary transfer device 6L is arranged to face the roller 12L with the intermediate transfer belt 5L interposed therebetween. The paper P fed from a feeding unit (not illustrated) is fed between such a roller 12L (the intermediate transfer belt 5L) and the secondary transfer device 6L at predetermined timing under the control of the controller 20. When the paper P is fed between the roller 12L (the intermediate transfer belt 5L) and the secondary transfer device 6L in a paper conveying direction D3, the combined color image supported on the intermediate transfer belt 5L is transferred onto the paper P at a time by the action of the secondary transfer device 6L.

Subsequently, the combined color image on the paper P is fixed by heat and pressure using a fixing device 14L, and the paper is ejected into an output tray (not illustrated). On the other hand, the toner left untransferred that adheres to the surface of the intermediate transfer belt 5L after the transfer of the combined color image is removed by a cleaning device 15L.

The controller 20 is, for example, of a central processing unit (CPU) or of a microcontroller, and controls the whole of the color image forming apparatus 1. A storage unit 21 is, for example, an electrically erasable or programmable read-only memory (EEPROM) and stores therein data controlled by the controller 20, such as a computer program, various setting information, and a required light amount value and a light amount adjusting value that are described later, in a rewritable manner. A displaying unit 23 is, for example, a liquid crystal display panel and displays various images under the control of the controller 20.

Figure 2:
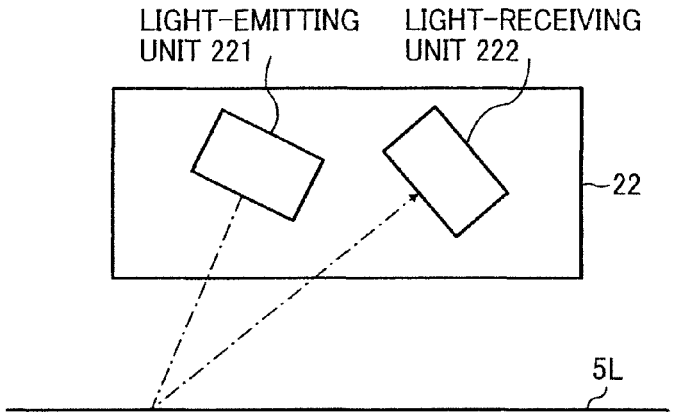
FIG. 2 is a schematic diagram of a structure of an optical sensor illustrated in FIG. 1.

FIG. 2 is a schematic diagram of a structure of the optical sensor 22. As illustrated in FIG. 2, the optical sensor 22 includes a light-emitting unit 221 that is, for example, a LED light source for irradiating the intermediate transfer belt 5L with light, and a light-receiving unit 222 that is, for example, a phototransistor for detecting light reflected from the intermediate transfer belt 5L. A signal that is received in the light-receiving unit 222 and that indicates the detection of light reflected from the intermediate transfer belt 5L is output into the controller 20. The optical sensor 22 detects toner images formed on the intermediate transfer belt 5L such as a light amount adjustment pattern, a trigger pattern, and a color-shift detection pattern. The optical sensor 22 is provided in plurality in a main-scanning direction of the intermediate transfer belt 5L (direction orthogonal to the belt-movement direction).

The controller 20 expands computer programs stored in the storage unit 21 into an internal random access memory (RAM) so as to run the computer programs subsequently, and thus outputs control signals to each unit in the color image forming apparatus 1 to control the whole of the color image forming apparatus 1. For example, the color image forming apparatus 1 forms a color image on the paper P as described above under the control of the controller 20. During the formation of the color image, the controller 20 reads setting information regarding color shift correction stored in the storage unit 21 and controls timing for forming electrostatic latent images on the photosensitive drums 2K, 2M, 2C, and 2Y by the optical beam scanner 16L based on the setting information. Accordingly, the color image forming apparatus 1 can form a color image without color shifting on the paper P.

The controller 20 also reads setting information regarding light amount adjustment stored in the storage unit 21 and controls the amount of light radiated from the light-emitting unit 221 based on the setting information. This enables the color image forming apparatus 1 to adjust an output signal output from the light-receiving unit 222 that detects light which is radiated from the light-emitting unit 221 and is reflected from the intermediate transfer belt 5L to a desired value.

Figure 3:
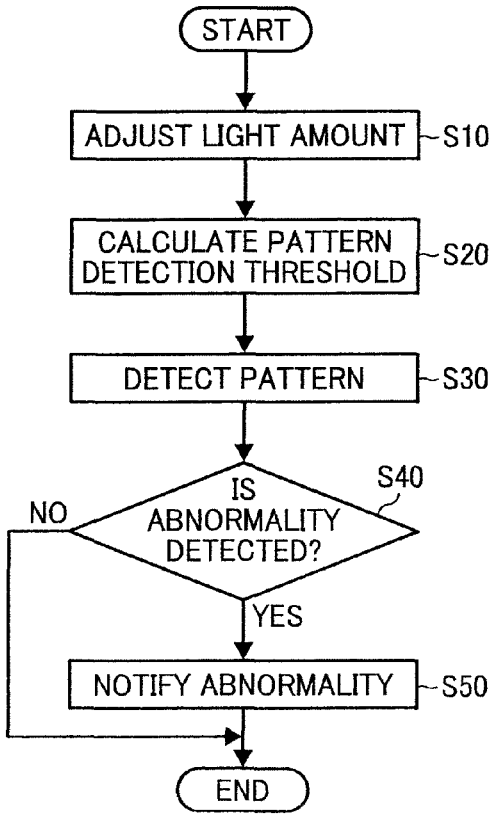
FIG. 3 is a flowchart of a process for setting setting information regarding color shift correction and light amount adjustment.

FIG. 3 is a flowchart of a process for setting setting information regarding color shift correction and light amount adjustment. As illustrated in FIG. 3, when the process starts, the color image forming apparatus 1 adjusts the amount of light radiated from the light-emitting unit 221 under the control of the controller 20 (S10).

Figure 4:
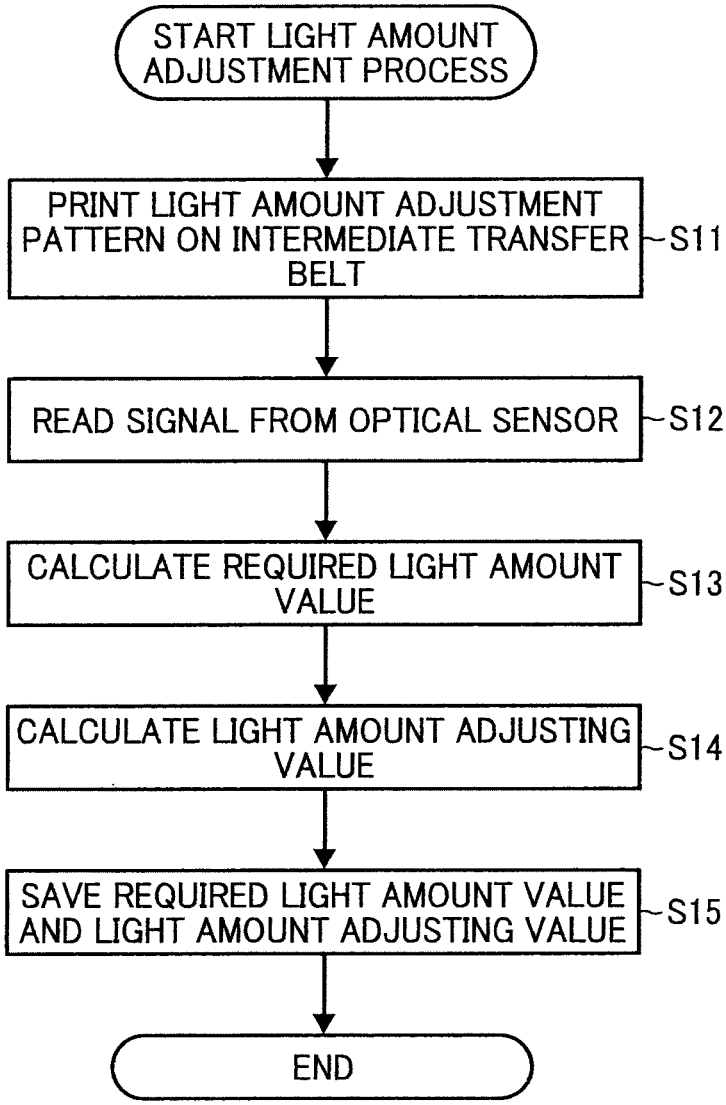
FIG. 4 is a flowchart of a light amount adjustment process.

FIG. 4 is a flowchart of a light amount adjustment process. As indicated in FIG. 4, when light amount adjustment starts at S10, the color image forming apparatus 1 forms (prints) a light amount adjustment pattern on the intermediate transfer belt 5L under the control of the controller 20 (S11).

Figure 5:
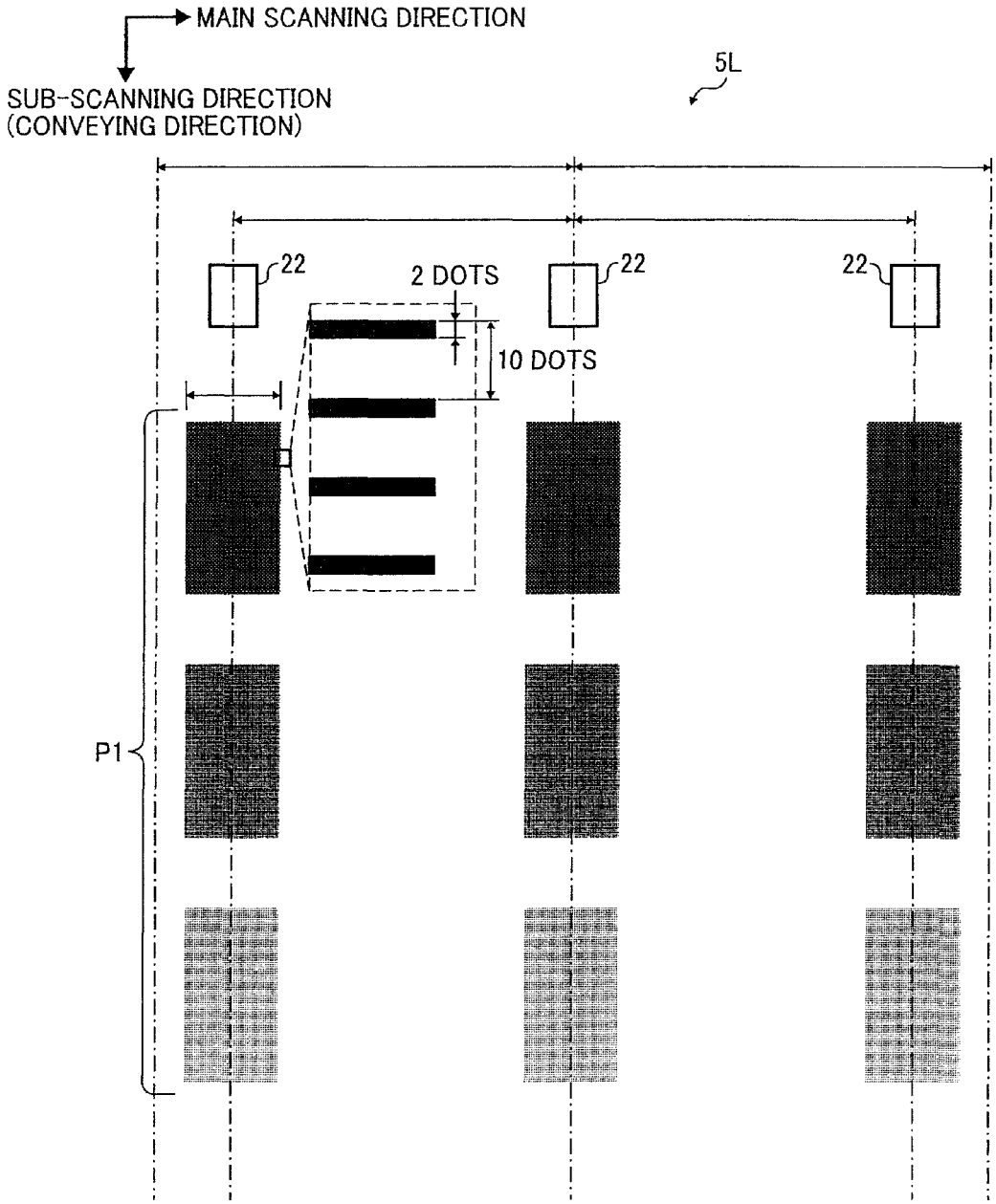
FIG. 5 is a schematic diagram of a light amount adjustment pattern formed on an intermediate transfer belt illustrated in FIG. 1.

FIG. 5 is a schematic diagram of a light amount adjustment pattern P1 formed on the intermediate transfer belt 5L. As illustrated in FIG. 5, the light amount adjustment pattern P1 is formed at a position corresponding to each of the optical sensor 22 arranged in plurality in a main-scanning direction. Therefore, each of the optical sensors 22 detects the light amount adjustment pattern P1 while the intermediate transfer belt 5L moves in a sub-scanning direction.

The light amount adjustment pattern P1 is formed of a plurality of belt-like images having a predetermined width (2 dots in the illustrated example) and having the same concentration at a predetermined pitch (10 dots in the illustrated example) that is smaller than the size of a sensor spot in a sub-scanning direction. From the patterns, the optical sensor 22 can obtain an output signal depending on the presence or absence of the belt-like images. Moreover, as illustrated in FIG. 5, the light amount adjustment pattern P1 is formed of a plurality of images with different color in a sub-scanning direction with predetermined free space interposed therebetween. Therefore, the optical sensor 22 can obtain a signal value in each color.

The controller 20 reads output signals of the optical sensor 22 obtained by detecting the light amount adjustment pattern P1 formed on the intermediate transfer belt 5L (S12). The controller 20 calculates a light amount needed to be radiated from the light-emitting unit 221, that is, a required light amount value that indicates a light amount required for the light-emitting unit 221, on each color, to set the output signal value of the optical sensor 22 to a desired value (target output value) (S13).

Figure 6:
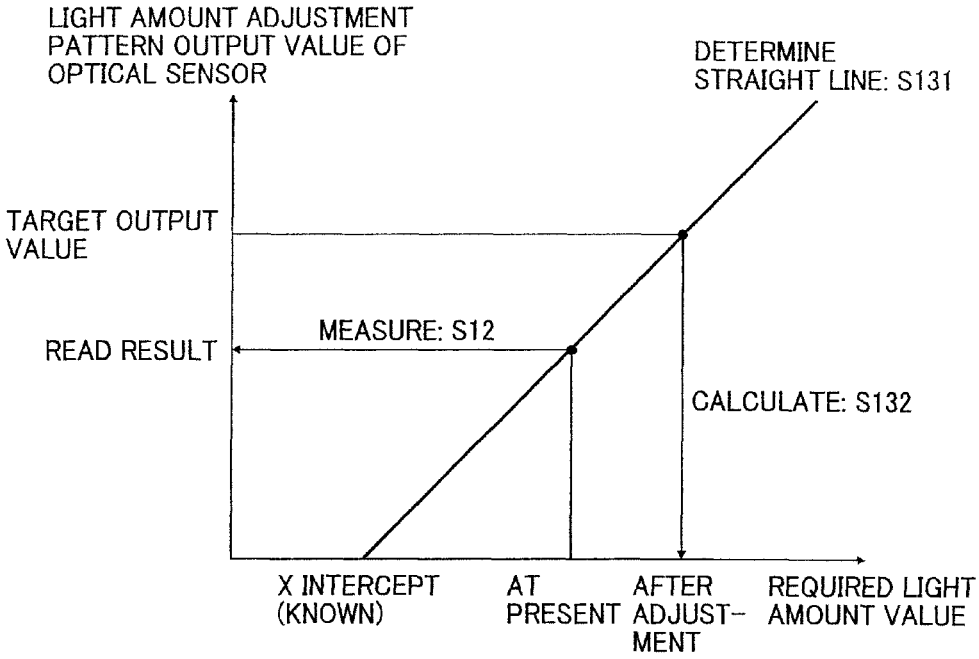
FIG. 6 is a graph illustrating calculation of a required light amount value based on an output value of the optical sensor.

The calculation of the required light amount value will be explained with reference to FIG. 6. FIG. 6 is a graph illustrating calculation of a required light amount value based on an output value of the optical sensor 22. Specifically, FIG. 6 is a graph illustrating calculation of a required light amount value based on an output value of the optical sensor 22 when the light amount adjustment pattern P1 is red with a light amount currently set in the light-emitting unit 221.

As indicated in FIG. 6, a straight line of the graph is determined by the read result when the light amount adjustment pattern P1 is detected with a light amount currently set (S12) and an x intercept (S131). The x intercept is a light amount adjusting value for the light-emitting unit 221 at which the output value of the optical sensor 22 becomes zero and is previously stored in the storage unit 21 as a specific data of the color image forming apparatus 1. As described above, when the color of the light amount adjustment pattern P1 is changed into a plurality of colors to obtain the output value of the optical sensor 22, the straight line of the graph can be determined by, for example, plotting the largest output value on the graph.

Subsequently, a required light amount value, which becomes a target output value when the light amount adjustment pattern P1 is detected by the optical sensor 22, is calculated based on the straight line determined (S132). In such a manner, in the color image forming apparatus 1, the required light amount value is calculated that makes the output signal value of the optical sensor 22 to be the target output value. The calculation of the required light amount value is represented as an equation below:

(Required light amount value)=(current light amount set value−*x* intercept)×target output value/read result value+*x* intercept).

Subsequent to S13, the controller 20 calculates a light amount adjusting value as a light amount to be set in the light-emitting unit 221 using the calculated required light amount value and a specified upper limit (limiting value) preset based on a specified upper limit of the driving voltage of the light-emitting unit 221 (S14). Specifically, the largest value between the required light amount value and the specified upper limit is used at S14 because the light amount adjusting value for the light-emitting unit 221 cannot be set so as to exceed the specified upper limit. The light amount adjusting value is represented as an equation below:

Light amount adjusting value=max(required light amount value, specified upper limit), where when required light amount value>specified upper limit, light amount adjusting value=specified upper limit.

The controller 20 stores the calculated required light amount value and light amount adjusting value in the storage unit 21 (S15) to terminate the light amount adjustment process.

The required light amount value and the light amount adjusting value may be stacked in the storage unit 21 to be recorded at S15. In this case, in the color image forming apparatus 1, the required light amount value and the light amount adjusting value are recorded in the storage unit 21 subsequently whenever the light amount adjustment process is performed. The required light amount value and the light amount adjusting value recorded in the storage unit 21 subsequently may be output by being printed on the paper P or being displayed on the displaying unit 23 under the control of the controller 20. Accordingly, the color image forming apparatus 1 can monitor the degree of aged deterioration such as contamination of a sensor from the required light amount value and the light amount adjusting value recorded subsequently.

As shown in FIG. 3, after the light amount adjustment process, the color image forming apparatus 1 calculates a pattern detection threshold for performing color shift correction using the required light amount value and the light amount adjusting value under the control of the controller 20 (S20) and detects a color shift correction pattern using the calculated pattern detection threshold (S30).

At S20, a pattern detection threshold Vt is calculated with an equation below using a standard threshold preset as factory default or the like, an offset value, x intercept, and the light amount adjusting value and the required light amount value, both of which are stored in the storage unit 21 at S10.

Pattern detection threshold $Vt$=standard threshold× (light amount adjusting value−$x$ intercept)/(required light amount value−$x$ intercept)+offset value(unit: $V$)

Accordingly, when the required light amount value does not exceed the specified upper limit, light amount adjusting value=required light amount value. Therefore, the pattern detection threshold Vt is a value obtained by adding the offset value to the preset standard threshold. In contrast, when the required light amount value exceeds the specified upper limit, light amount adjusting value=specified upper limit. Therefore, the pattern detection threshold Vt is a value obtained by adding the offset value to the standard threshold reduced to the extent corresponding to the decreased necessary output value obtained by required light amount value-specified upper limit.

In other words, the pattern detection threshold Vt does not vary so long as the required light amount value does not exceed the specified upper limit. Therefore, the pattern detection threshold Vt is not affected by sudden fluctuation due to the light amount adjustment, and thus, the color image forming apparatus 1 can stably detect patterns. On the other hand, when the required light amount value increases due to aged deterioration such as contamination of a sensor and exceeds the specified upper limit, the pattern detection threshold Vt is set to decrease depending on the degree. Accordingly, pattern detection in response to aged deterioration such as contamination of a sensor can be operated.

Figure 7:
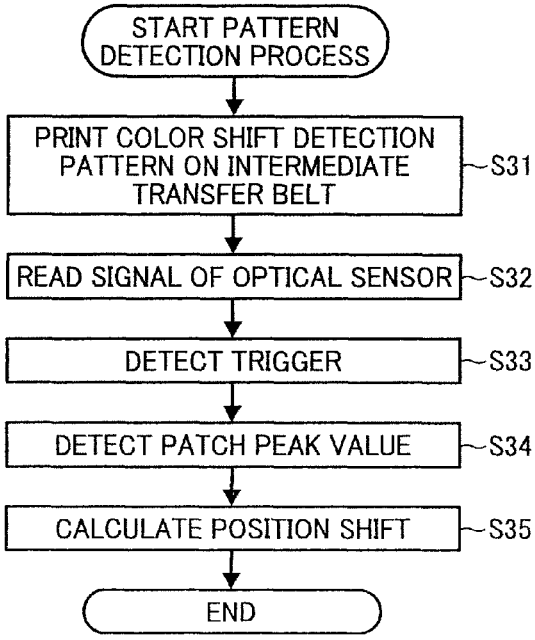
FIG. 7 is a flowchart of a pattern detection process.

FIG. 7 is a flowchart of a pattern detection process and specifically is a flowchart of a pattern detection process for color shift correction at S30. As indicated in FIG. 7, when pattern detection starts at S30, the color image forming apparatus 1 forms (prints) a color shift detection pattern on the intermediate transfer belt 5L under the control of the controller 20 (S31).

Figure 8:
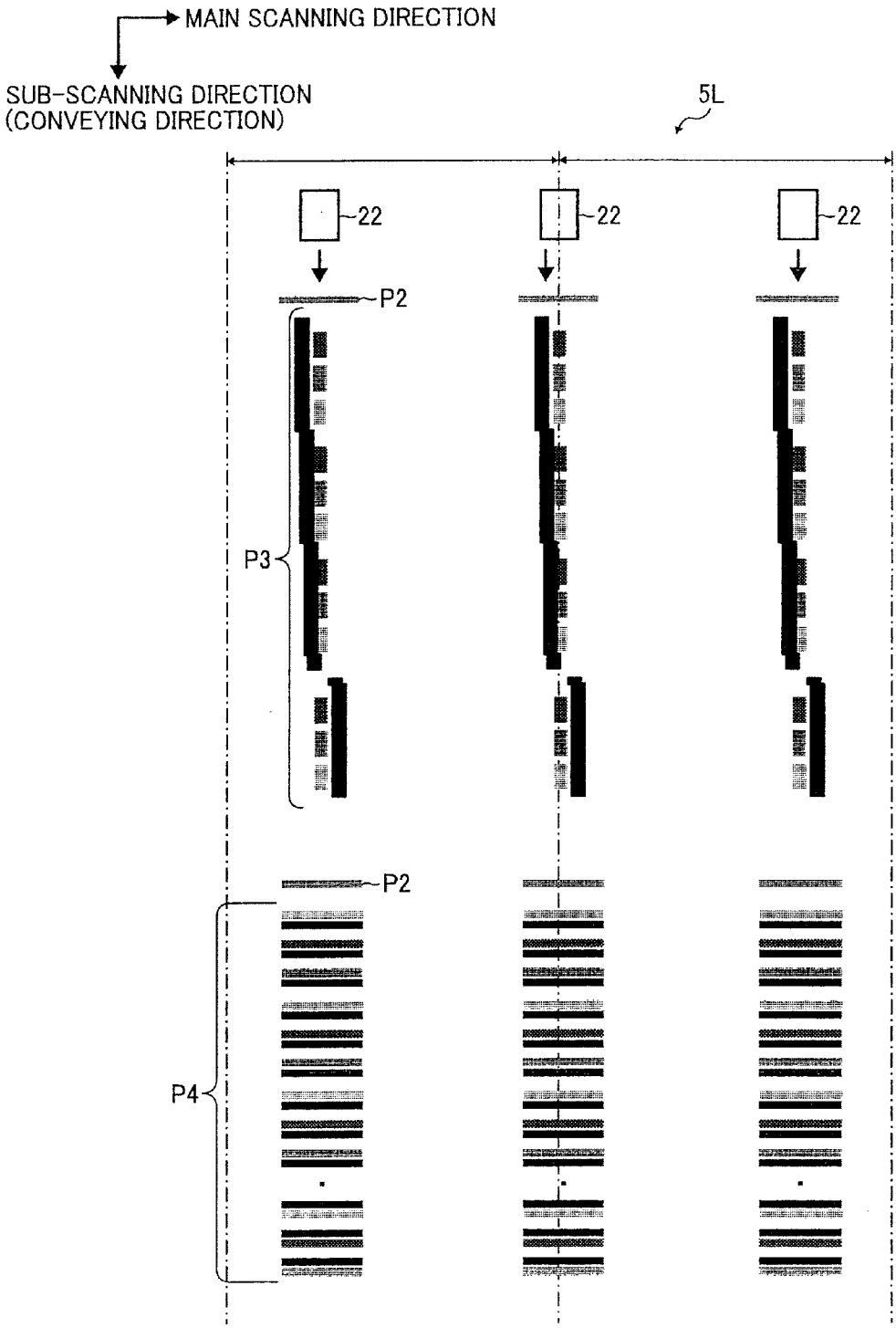
FIG. 8 is a schematic diagram of color shift detection patterns formed on the intermediate transfer belt.

FIG. 8 is a schematic diagram of a color shift detection patterns formed on the intermediate transfer belt 5L. As illustrated in FIG. 8, a main-scanning color-shift detection pattern P3 and a sub-scanning color-shift detection pattern P4 are formed after trigger patterns P2 in a sub-scanning direction of the intermediate transfer belt 5L in the pattern detection process.

The trigger patterns P2 are pattern images that indicate the start of the main-scanning color-shift detection pattern P3 and the sub-scanning color-shift detection pattern P4. The main-scanning color-shift detection pattern P3 is pattern images for detecting the position shifts of each color of yellow, cyan, magenta, and black in a main-scanning direction. The sub-scanning color-shift detection pattern P4 is pattern images for detecting the position shifts of each color of yellow, cyan, magenta, and black in a sub-scanning direction. These pattern images as color-shift detection patterns are also simply called a patch. The main-scanning color-shift detection pattern P3 and the sub-scanning color-shift detection pattern P4 are a series of patch groups in which an overlapped amount between color patches and reference color patches are shifted to be changed in a main direction (or in a sub direction) in order.

In such a manner, the color-shift detection patterns are formed on the intermediate transfer belt 5L at positions corresponding to each of the optical sensor 22 arranged in plurality in a main-scanning direction at S31. Therefore, in the color image forming apparatus 1, each of the optical sensors 22 detects the color-shift detection patterns while the intermediate transfer belt 5L moves in a sub-scanning direction to enable a color shift at each main-scanning position to be detected.

Subsequent to S31, the controller 20 reads an output signal of the optical sensor 22 obtained by detecting the color-shift detection patterns formed on the intermediate transfer belt 5L (S32). The controller 20 detects an output signal exceeding the pattern detection threshold Vt at first, thereby detecting the trigger patterns P2 (S33).

The controller 20 repeats detection of the largest value in predetermined time based on the detected peak positions of the trigger patterns P2 to detect patch peak values of the main-scanning color-shift detection pattern P3 and the sub-scanning color-shift detection pattern P4, that is, detects the color-shift detection patterns (S34).

The controller 20 calculates position shift amount (color shift amount) of each color based on the peak values of the main-scanning color-shift detection pattern P3 and the sub-scanning color-shift detection pattern P4 detected at S34 based on the trigger patterns P2 detected at S33 (S35). For example, current color shift amount can be obtained from the deference between a measured position where the output signal is the smallest and an ideal position where a color shift is the smallest in an ideal state.

The position shift amount calculated at S35 is stored in the storage unit 21 as setting information regarding color shift correction. The controller 20 controls timing for forming each color relative to reference color based on the position shift amount while forming color images. Accordingly, the color image forming apparatus 1 can form a color image without color shifting.

As indicated in FIG. 3, after the pattern detection process at S30, in the color image forming apparatus 1, the controller 20 judges whether abnormal detection occurs during the detection of the color-shift detection patterns based on the output signal of the optical sensor 22 read at S32 (S40). When abnormal detection is confirmed by the judgment (Yes at S40), the color image forming apparatus 1, under the control of the controller 20, notifies the abnormality to users by displaying the notification about the presence of abnormality in color shift detection on the displaying unit 23 (S50).

The abnormal detection during the detection of color-shift detection patterns means abnormality during detection of the positions of the color-shift detection patterns based on the output signal of the optical sensor 22 obtained by detecting the color-shift detection patterns. Specifically, an output signal exceeding the pattern detection threshold Vt cannot be detected within predetermined time, which may end up in failed reading of color-shift detection patterns. In addition, reading of the color-shift detection patterns may not be completed, specifically, the detection of the output signal exceeding the pattern detection threshold Vt starts but not ends within a predetermined time, for example. Moreover, the output value of the optical sensor 22, when the color-shift detection patterns are detected, may not fall within a predetermined range, which is regarded to be abnormal.

Figure 9:
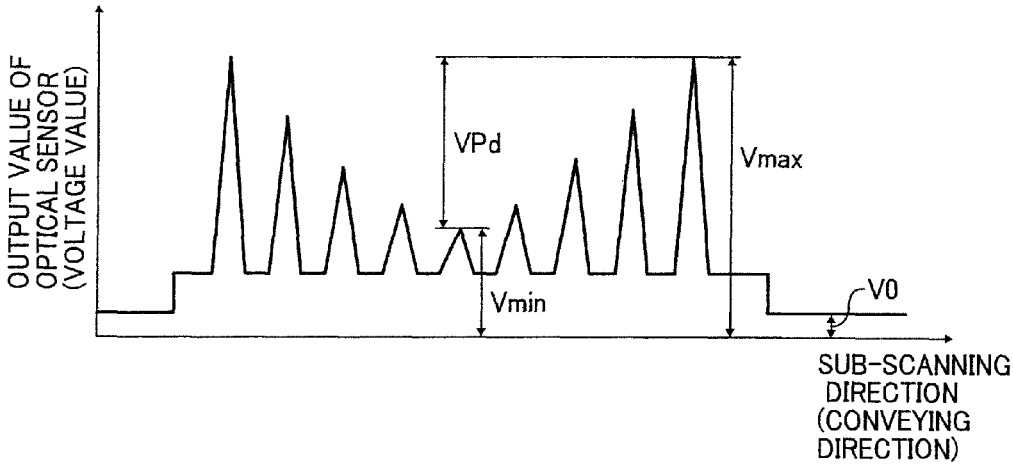
FIG. 9 is a graph of an output value (voltage value) of the optical sensor when a color shift detection pattern is detected.

The output value of the optical sensor 22 will be explained with reference to FIG. 9. FIG. 9 is a graph of an output value (voltage value) of the optical sensor 22 when a color shift detection pattern is detected. More specifically, FIG. 9 is an exemplary graph of an output value of the optical sensor 22 when the sub-scanning color-shift detection pattern is detected along the sub-scanning direction.

As indicated in FIG. 9, the color shift detection pattern corresponds to a peak of the output value of the optical sensor 22. Vmax denotes the largest peak value of the output value of the optical sensor 22, Vmin denotes the smallest peak value of the output value of the optical sensor 22, Vpd denotes a difference value between Vmax and Vmin, and V0 denotes a value when the base of the intermediate transfer belt 5L on which no pattern is formed is detected. Although the output of patches in each color appears alternatively in time series when the color shift detection patterns of FIG. 8 are detected in practice, FIG. 9 illustrates focusing on only particular color for convenience.

As an example of the abnormality in the output value of the optical sensor 22, a color shift detection pattern may be mistakenly detected due to the abnormality in the light amount of the light-emitting unit 221. As a result, the magnitude relation between V0 indicating the base of the belt and the peak values (Vmax and Vmin) indicating the color shift detection pattern may be reversed compared with the normal magnitude relation. Therefore, the presence or absence of the abnormal detection occurrence can be judged by judging whether the magnitude relation between V0 and the peak values indicating the color shift detection pattern are normal.

As another example of the abnormality in the output value of the optical sensor 22, the light amount of the light-emitting unit 221 may abnormally increase, and the largest peak value (Vmax) indicating a color shift detection pattern may exceed a predetermined threshold. Therefore, the presence or absence of the abnormal detection occurrence can be judged by judging whether the largest peak value (Vmax) is equal to or more than the predetermined threshold. As another example of the abnormality in the output value of the optical sensor 22, the light amount of the light-emitting unit 221 may abnormally decrease, and the largest peak value (Vmax) indicating a color shift detection pattern may be below a predetermined threshold. Therefore, the presence or absence of the abnormal detection occurrence can be judged by judging whether the largest peak value (Vmax) is equal to or less than the predetermined threshold.

As another example of the abnormality in the output value of the optical sensor 22, the light amount of the light-emitting unit 221 may abnormally decrease, and the smallest peak value (Vmin) indicating a color shift detection pattern may be equal to or less than a predetermined threshold. Therefore, the presence or absence of the abnormal detection occurrence can be judged by judging whether the smallest peak value (Vmin) is equal to or less than the predetermined threshold. As another example of the abnormality in the output value of the optical sensor 22, the light amount of the light-emitting unit 221 may abnormally increase, and the smallest peak value (Vmin) indicating a color shift detection pattern may be equal to or more than a predetermined threshold. Therefore, the presence or absence of the abnormal detection occurrence can be judged by judging whether the smallest peak value (Vmin) is equal to or more than the predetermined threshold.

As another example of the abnormality in the output value of the optical sensor 22, the received light amount of the light-receiving unit 222 may decrease due to, for example, contamination of the light-receiving unit 222, and a difference value between the largest peak value (Vmax) indicating a color shift detection pattern and V0 indicating the base of the belt may be equal to or less than a predetermined threshold. Therefore, the presence or absence of the abnormal detection occurrence can be judged by judging whether the difference value between the largest peak value (Vmax) indicating the color shift detection pattern and V0 indicating the base of the belt is equal to or less than the predetermined threshold.

As another example of the abnormality in the output value of the optical sensor 22, the received light amount of the light-receiving unit 222 may decrease due to, for example, contamination of the light-receiving unit 222, and the difference value VPd between the largest peak value (Vmax) indicating a color shift detection pattern and the smallest peak value (Vmin) may be equal to or less than a predetermined threshold. Therefore, the presence or absence of the abnormal detection occurrence can be judged by judging whether the difference value VPd is equal to or less than the predetermined threshold.

The threshold for judging the presence or absence of the abnormal detection occurrence as described above (hereinafter, referred to as "an abnormality judging value") is a fixed value preset as factory default or the like. In addition to this, the threshold may be a variable value determined from the required light amount value and the light amount adjusting value obtained by limiting the required light amount value using the specified upper limit, both of which are stored in the storage unit 21 at S10 as with the pattern detection threshold Vt. Specifically, an abnormality judging value Vc is calculated with an equation below using a standard threshold preset as factory default or the like, an offset value, x intercept, the light amount adjusting value and the required light amount value stored in the storage unit 21 at S10, and the like.

Abnormality judging value $Vc$=standard threshold×(light amount adjusting value−$x$ intercept)/(required light amount value−$x$ intercept)+offset value(unit: $V$)

Accordingly, when the required light amount value does not exceed the specified upper limit, light amount adjusting value=required light amount value. Therefore, the abnormality judging value Vc is a value obtained by adding the offset value to the preset standard threshold. In contrast, when the required light amount value exceeds the specified upper limit, light amount adjusting value=specified upper limit. Therefore, the abnormality judging value Vc is a value obtained by adding the offset value to the standard threshold reduced to the extent corresponding to the decreased necessary output value obtained by required light amount value-specified upper limit.

In other words, the abnormality judging value Vc does not vary so long as the required light amount value does not exceed the specified upper limit. Therefore, the abnormality judging value Vc is not affected by sudden fluctuation due to the light amount adjustment, and thus, the color image forming apparatus 1 can stably judge abnormal detection during the detection of color-shift patterns. On the other hand, when the required light amount value increases due to aged deterioration such as contamination of a sensor and exceeds the specified upper limit, the abnormality judging value Vc decreases depending on the degree. Accordingly, abnormal detection during the detection of color-shift patterns in response to aged deterioration such as contamination of a sensor can be judged.

For example, when the output decreases in correspondence with the decrease in the light amount due to contamination of a sensor or similar reasons over time, the output waveform of the optical sensor 22 takes a simply proportionately compressed form. The abnormality judging value Vc also decreases corresponding to this proportional compression, which enables the color-shift patterns to be detected depending on the degree of contamination of a sensor. Therefore, a margin until the detection of color-shift patterns is judged as abnormal detection can increase depending on the degree of contamination of a sensor.

Modified Embodiment

A modified embodiment below describes light amount adjustment using a detected result of color-shift detection patterns in the latest process. As indicated in FIG. 3, the embodiment described above calculates the threshold of the pattern detection amount and detects the color-shift detection patterns after the light amount adjustment using the light amount adjustment pattern P1. On the other hand, the modified embodiment adjusts the light amount using the detected result of color-shift detection patterns in the latest process and thus does not need to adjust the light amount using the light amount adjustment pattern P1. Accordingly, the modified embodiment can reduce processing time and toner consumption.

Specifically, the straight line of the graph exemplified in FIG. 6 is determined using the read result when the main-scanning color-shift detection pattern P3 and the sub-scanning color-shift detection pattern P4 are detected with a light amount currently set and the x intercept described above at the pattern detection (S30) in FIG. 3. The largest value of a plurality of the peak values or an average value of the first largest value and the second largest value of the output value exemplified in FIG. 9 may be used as the read result when the main-scanning color-shift detection pattern P3 and the sub-scanning color-shift detection pattern P4 are detected. This is because the pattern with the largest peak value in each pattern formed in a predetermined concentration does not shift its position against the optical sensor 22 and therefore is a color-shift detection pattern suitable for the use in light amount adjustment.

Subsequently, a required light amount value with which the output value when the main-scanning color-shift detection pattern P3 and the sub-scanning color-shift detection pattern P4 are detected by the optical sensor 22 becomes a target output value is calculated based on the straight line determined. The target output value used in this modified embodiment may be different from the target output value used in the embodiment described above because the pattern is different. In such a manner, the color image forming apparatus 1 may calculate the required light amount value that makes the output signal value of the optical sensor 22 become the target output value. The calculation of the required light amount value and the calculation of the light amount adjusting value obtained by using the calculated required light amount value are performed in a similar manner as with the calculation when the light amount adjustment pattern P1 is used.

Subsequently, the calculated required light amount value and light amount adjusting value are stored in the storage unit 21. Therefore, the required light amount value and the light amount adjusting value stored in the storage unit 21 may be simply read at the next process, and light amount adjustment using the light amount adjustment pattern P1 is not needed to be performed.

The computer program run in the color image forming apparatus in the embodiment as described above is previously built in a read only memory (ROM) or the like to be provided. The computer program run in the color image forming apparatus in the embodiment may be stored in a recording medium readable by a computer, such as a compact disc-ROM (CD-ROM), a flexible disk (FD), a CD recordable (CD-R), and a digital versatile disk (DVD), in an installable form or an executable form to be provided. The computer program run in the color image forming apparatus in the embodiment may also be stored in a computer connected to a network such as the Internet and may be downloaded via the network to be provided. The computer program run in the color image forming apparatus in the embodiment may also be provided or distributed via a network such as the Internet.

Moreover, the computer program described above may be a printer driver run by information equipment such as a personal computer (PC) connected to the color image forming apparatus through an interface (I/F) unit. In other words, the color image forming apparatus may control color shift correction using a computer program such as a printer driver run by information equipment such as a PC.

The color image forming apparatus in the embodiment can be applied for any of a complex machine including at least two functions out of a copy function, a printer function, a scanner function, and a facsimile function, a printer, a scanner, a facsimile, and a similar apparatus.

According to the present invention, pattern detection in response to aged deterioration such as contamination of a sensor can be performed during image quality adjustment.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that forms an image on an image carrier and transfers the image thus formed on paper to be fixed, the image forming apparatus comprising:

an obtaining unit that radiates light from a light-emitting unit onto the image carrier and that obtains an output value of a light-receiving unit having received the light reflected from the image carrier;

a light amount setting unit that calculates a required light amount value indicating a light amount required for the light-emitting unit based on the output value and that sets a light amount adjusting value indicating a light amount of the light-emitting unit using a limiting value preset as an upper limit based on the required light amount value thus calculated;

a detecting unit that detects a pattern image by forming the pattern image to perform image quality adjustment on the image carrier and by judging whether an output value obtained by radiating light of the light amount adjusting value from the light-emitting unit exceeds a predetermined threshold for performing the image quality adjustment; and a controller that controls image formation on the image carrier based on a detected result by the detecting unit, wherein the detecting unit maintains the threshold at a constant value when the required light amount value does not exceed the limiting value, and reduces the threshold when the required light amount value exceeds the limiting value depending on a degree of the excess, the limiting value being an upper limit of a driving voltage of the light-emitting unit, the pattern image includes a plurality of images, having predetermined widths, varying in a plurality of colors, and which are formed at a predetermined pitch with non-color area between the plurality of images in a sub-scanning direction of the image carrier, and the obtaining unit obtains respective output values corresponding to each of the plurality of colors from each of a plurality of sensors, each sensor including one of the light-emitting unit and one of the light-receiving unit.

2. The image forming apparatus according to claim 1, wherein the detecting unit calculates the threshold by adding a predetermined offset value to standard threshold×(light amount adjusting value−x intercept)/(required light amount value−x intercept), where the standard threshold indicates a preset threshold, and the x intercept is the light amount adjusting value when the light amount of the light-emitting unit is zero.

3. The image forming apparatus according to claim 1, further comprising:

a recorder that records the required light amount value calculated by the light amount setting unit and the light amount adjusting value set based on the required light amount value subsequently; and an outputting unit that outputs the required light amount value and a light amount set value recorded in the recording unit subsequently.

4. The image forming apparatus according to claim 1, further comprising a judging unit that judges presence or absence of abnormal detection of the pattern image depending on a comparative result with a predetermined judgment value based on the output value that the detecting unit obtains when detecting the pattern image, wherein the judging unit reduces the judgment value when the required light amount value exceeds the limiting value depending on the degree of the excess.

5. The image forming apparatus according to claim 1, wherein the detecting unit detects a color-shift detection pattern image for correcting color shift in an image in a plurality of colors by forming the color-shift detection pattern image on the image carrier, and the controller controls color image formation on the image carrier based on a detected result of the color-shift detection pattern image.

6. The image forming apparatus according to claim 1, further comprising a storage unit that stores therein the output value that the detecting unit obtains by forming the pattern image to perform image quality adjustment on the image carrier, wherein the light amount setting unit calculates the required light amount value based on the output value stored in the storage unit at a latest process and sets the light amount adjusting value based on the required light amount value thus calculated.

7. A detecting method for detecting a pattern image to perform image quality adjustment used in an image forming apparatus that forms an image on an image carrier and transfers the image thus formed on paper to be fixed, the detecting method comprising:

radiating light from a light-emitting unit onto the image carrier and obtaining an output value of a light-receiving unit having received the light reflected from the image carrier;

calculating a required light amount value indicating a light amount required for the light-emitting unit based on the output value and setting a light amount adjusting value indicating a light amount of the light-emitting unit using a limiting value preset as an upper limit based on the required light amount value thus calculated;

detecting a pattern image to perform image quality adjustment by forming the pattern image on the image carrier and by judging whether an output value obtained by radiating light of the light amount adjusting value from the light-emitting unit exceeds a predetermined threshold for performing the image quality adjustment; and controlling image formation on the image carrier based on a detected result by the detecting unit, wherein the detecting includes maintaining the threshold at a constant value when the required light amount value does not exceed the limiting value, and reducing the threshold when the required light amount value exceeds the limiting value depending on a degree of the excess the limiting value being an upper limit of a driving voltage of the light-emitting unit, the pattern image includes a plurality of images, having predetermined widths, varying in a plurality of colors, and which are formed at a predetermined pitch with non-color area between the plurality of images in a sub-scanning direction of the image carrier, and the obtaining includes obtaining respective output values corresponding to each of the plurality of colors from each of a plurality of sensors, each sensor including one of the light-emitting unit and one of the light-receiving unit.

8. The detecting method according to claim 7, wherein the detecting includes calculating the threshold by adding a predetermined offset value to standard threshold× (light amount adjusting value−x intercept)/(required light amount value−x intercept), where the standard threshold indicates a preset threshold, and the x intercept is the light amount adjusting value when the light amount of the light-emitting unit is zero.

9. The detecting method according to claim 7, further comprising:

recording in a recording unit the required light amount value calculated by the light amount setting unit and the light amount adjusting value set based on the required light amount value subsequently; and outputting the required light amount value and a light amount set value recorded in the recording unit subsequently.

10. The detecting method according to claim 7, further comprising judging presence or absence of abnormal detection of the pattern image depending on a comparative result with a predetermined judgment value based on the output value that the detecting unit obtains when detecting the pattern image, wherein the judging includes reducing the judgment value when the required light amount value exceeds the limiting value depending on the degree of the excess.

11. The detecting method according to claim 7, wherein the detecting includes detecting a color-shift detection pattern image for correcting color shift in an image in a plurality of colors by forming the color-shift detection pattern image on the image carrier, and the controlling includes controlling color image formation on the image carrier based on a detected result of the color-shift detection pattern image.

12. The detecting method according to claim 7, further comprising storing in a storage unit the output value that the detecting unit obtains by forming the pattern image to perform image quality adjustment on the image carrier, wherein the light amount setting includes calculating the required light amount value based on the output value stored in the storage unit at a latest process and setting the light amount adjusting value based on the required light amount value thus calculated.

13. An image forming apparatus that forms an image on an image carrier and transfers the image thus formed on paper to be fixed, the image forming apparatus comprising:

means for obtaining an output value of a light-receiving unit that radiates light from a light-emitting unit onto the image carrier and that obtains the output value of a light-receiving unit having received the light reflected from the image carrier;

means for setting a light amount adjusting value that calculates a required light amount value indicating a light amount required for the light-emitting unit based on the output value and that sets a light amount adjusting value indicating a light amount of the light-emitting unit using a limiting value preset as an upper limit based on the required light amount value thus calculated;

means for detecting a pattern image by forming the pattern image to perform image quality adjustment on the image carrier and by judging whether an output value obtained by radiating light of the light amount adjusting value from the light-emitting unit exceeds a predetermined threshold for performing the image quality adjustment; and means for controlling image formation on the image carrier based on a detected result by the means for detecting, wherein the means for detecting maintains the threshold at a constant value when the required light amount value does not exceed the limiting value, and reduces the threshold when the required light amount value exceeds the limiting value depending on a degree of the excess, the limiting value being an upper limit of a driving voltage of the light-emitting unit, the pattern image includes a plurality of images, having predetermined widths, varying in a plurality of colors, and which are formed at a predetermined pitch with non-color area between the plurality of images in a sub-scanning direction of the image carrier, and the means for obtaining obtains respective output values corresponding to each of the plurality of colors from each of a plurality of sensors, each sensor including one of the light-emitting unit and one of the light-receiving unit.

14. The image forming apparatus according to claim 13, wherein the means for detecting calculates the threshold by adding a predetermined offset value to standard threshold× (light amount adjusting value-x intercept)/(required light amount value−x intercept), where the standard threshold indicates a preset threshold, and the x intercept is the light amount adjusting value when the light amount of the light-emitting unit is zero.

15. The image forming apparatus according to claim 13, further comprising:

means for recording therein the required light amount value calculated by the light amount setting unit and the light amount adjusting value set based on the required light amount value subsequently; and means for outputting that outputs the required light amount value and a light amount set value recorded in the means for recording subsequently.

16. The image forming apparatus according to claim 13, further comprising means for judging that judges presence or absence of abnormal detection of the pattern image depending on a comparative result with a predetermined judgment value based on the output value that the means for detecting obtains when detecting the pattern image, wherein the means for judging reduces the judgment value when the required light amount value exceeds the limiting value depending on the degree of the excess.

17. The image forming apparatus claim 13, wherein the means for detecting detects a color-shift detection pattern image for correcting color shift in an image in a plurality of colors by forming the color-shift detection pattern image on the image carrier, and the means for controlling controls color image formation on the image carrier based on a detected result of the color-shift detection pattern image.

18. The image forming apparatus claim 13, further comprising means for storing that stores therein the output value that the detecting unit obtains by forming the pattern image to perform image quality adjustment on the image carrier, wherein the means for setting calculates the required light amount value based on the output value stored in the means for storing at a latest process and sets the light amount adjusting value based on the required light amount value thus calculated.

19. The image forming apparatus according to claim 1, wherein the detecting unit detects the pattern image by forming the pattern image to include a plurality of images that vary in color in a conveying direction of the image carrier.

20. The image forming apparatus according to claim 1, further comprising the plurality of sensors, the sensors being arranged equidistantly across a main scanning direction of the image carrier.

* * * * *